United States Patent [19]

Edel et al.

[11] Patent Number: 4,758,045

[45] Date of Patent: Jul. 19, 1988

[54] SEAT FURNITURE

[75] Inventors: Hans-Joachim Edel, Minden; Karl-Heinz Prietsch, Petershagen, both of Fed. Rep. of Germany

[73] Assignee: Drabert Sohne GmbH & Co., Minden, Fed. Rep. of Germany

[21] Appl. No.: 26,334

[22] Filed: Mar. 16, 1987

[30] Foreign Application Priority Data

Mar. 15, 1986 [DE] Fed. Rep. of Germany ..... 3608718

[51] Int. Cl.[4] ..... A47C 3/00

[52] U.S. Cl. ..... 297/300; 297/304; 297/322

[58] Field of Search ..... 297/316, 320, 322, 300, 297/304

[56] References Cited

U.S. PATENT DOCUMENTS

| | | | |
|---|---|---|---|
| 1,359,145 | 11/1920 | Atwood | 297/304 |
| 1,368,469 | 2/1921 | Atwood | 297/304 |
| 3,602,537 | 8/1971 | Kerstholt et al. | 297/316 |
| 4,451,085 | 5/1984 | Franck et al. | 297/300 |
| 4,509,793 | 4/1985 | Wiesmann et al. | 297/300 X |
| 4,653,806 | 5/1987 | Willi | 297/300 |
| 4,668,012 | 5/1987 | Locker | 297/300 |

FOREIGN PATENT DOCUMENTS

| | | | |
|---|---|---|---|
| 637068 | 5/1950 | United Kingdom | 297/320 |

*Primary Examiner*—Francis K. Zugel

*Attorney, Agent, or Firm*—Pollock, Vande Sande and Priddy

[57] ABSTRACT

In seat furniture with a seat carrier (1) having an inclined front seat-carrier region, on which a seat (5) is articulated pivotably and so as to be longitudinally displaceable and a backrest carrier (9) with a backrest is articulated, the seat (5) is articulated at its front edge on the seat carrier (1). The seat (5) is held via a first lever arm (12) which is mounted pivotably on the seat carrier (1) and which forms with a second lever arm (13) a lever to which the backrest carrier (9) is connected firmly.

6 Claims, 2 Drawing Sheets

SEAT FURNITURE

Figure 1:
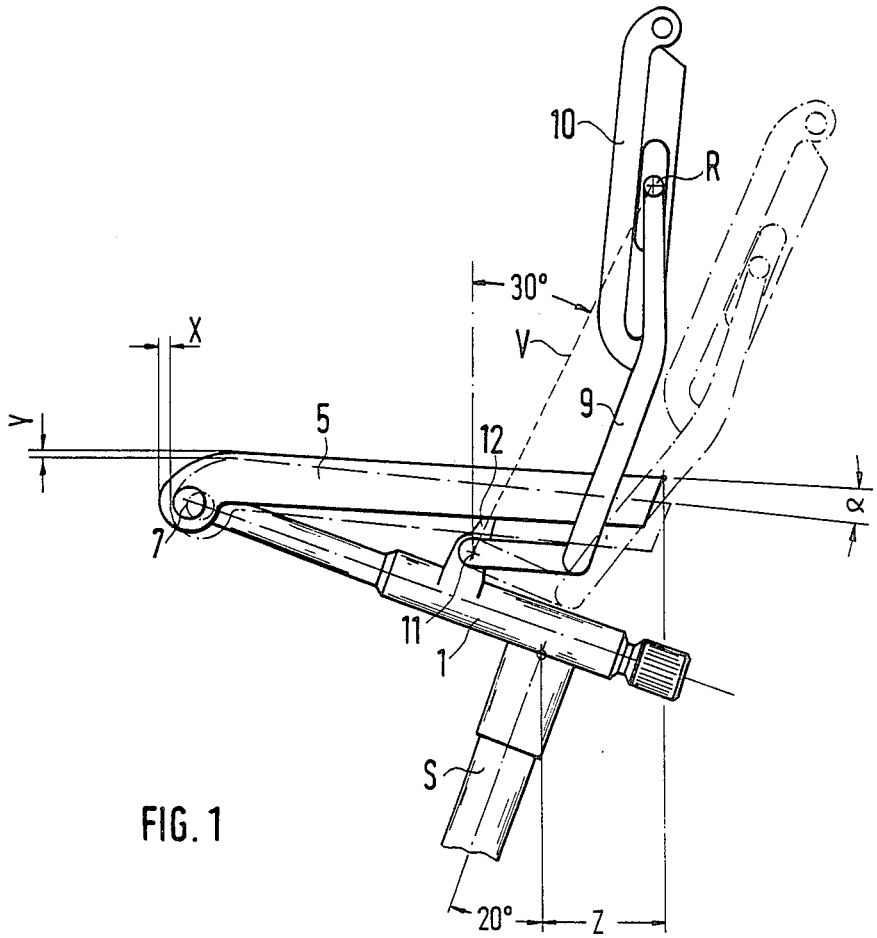

The invention relates to seat furniture, with a seat carrier having an inclined front seat-carrier region, on which a seat is articulated pivotably and so as to be longitudinally displacable and a backrest carrier with a backrest is articulated.

Seat furniture of this type is known from European Patent Specification No. 85,670. A disadvantage of this known solution is, among other things, that when the backrest is pivoted the seat taken with it rises at its front edge. The result of this is that the known chair construction does not have the same comfort in all its inclined positions. Because the front seat region rises unavoidably in the state of the art, it presses against the underside of the thigh and consequently impairs the circulation.

Starting from this state of the art, the object on which the invention is based is to provide for seat furniture of the known type a chair mechanism which, without detriment to aesthetic considerations, guarantees that when the backrest is titled back the seat can be taken with it without its front edge rising.

The chair according to the invention prevents the front edge of the seat from rising, so that the chair is comfortable in any pivoted position and foot contact with the floor is not reduced. The backrest, in conjunction with the seat, covers an ideal pivoting range which prevents the user's clothing from being shifted out of place at the back during movement.

The preferred exemplary embodiment of the invention is described in detail below with reference to the drawing.

Figure 2:
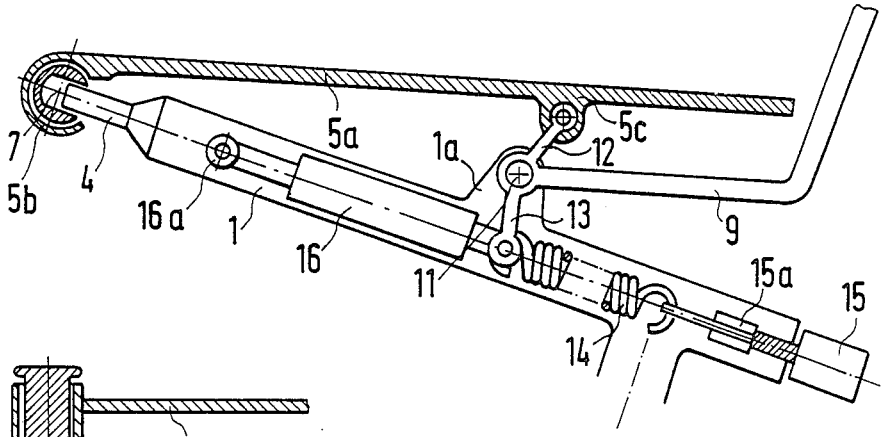
Figure 3:
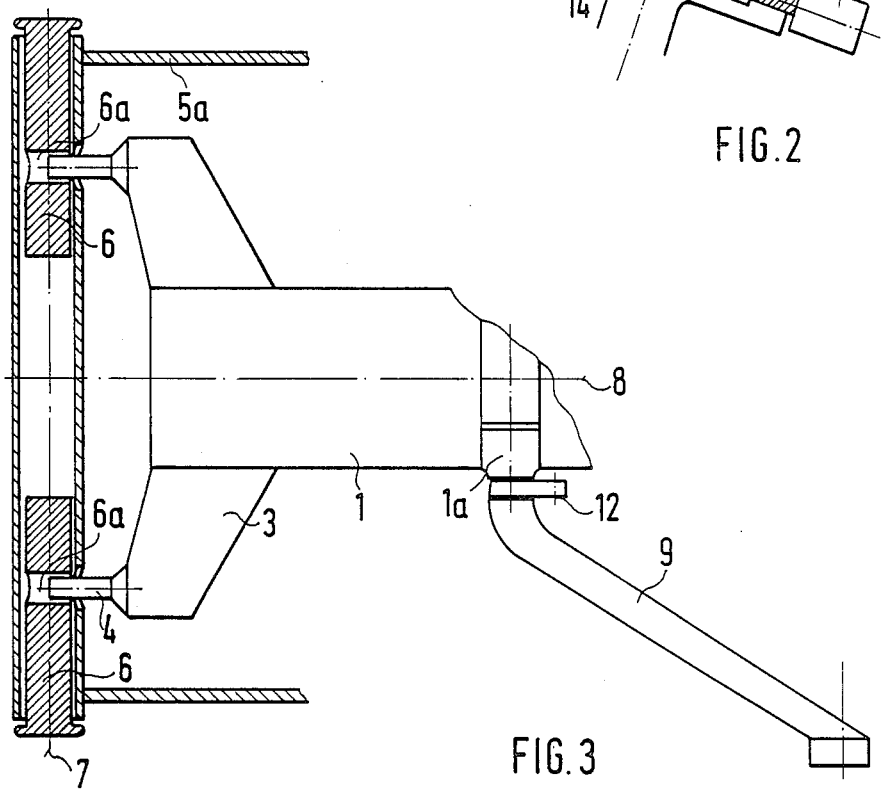

In the drawing:

FIG. 1 shows a diagrammatic side view of the upper part of the chair, with the range of movement indicated, FIG. 2 shows, in section, a side view of the critical mechanism, FIG. 3 shows a partially sectional plan view of the front seat mounting.

On a seat carrier 1 fastened in the usual way to a chair column (S) there are, at the front end extensions 3 which project towards the front edge of the seat and which terminate in pins 4 connected firmly to the extensions 3.

The seat 5, together with the seat frame or the seat plate 5*a*, is made hollow at its front edge 5*b*, at least at the lateral outer ends, so that pegs 6 can engage from both sides. The pegs 6 are mounted in the cylindrical hollow chamber at 5*b* so as to be pivotable about the horizontal axis 7. In the pegs 6 there are transverse bores 6*a* which make it possible to push the seat frame 5*a*, together with the pegs 6, onto the pins 4 fixed to the seat carrier or its extensions 3. The seat frame 5*a* is therefore pivotable about the axis 7 and is also displaceable in the direction of the longitudinal axis 8 of the seat.

In front of the junction between the chair column S and the seat carrier 1 there are, on both sides of the seat carrier, on the top side of the latter bearings 1*a* which are formed by the seat-carrier shell. The backrest carrier 9, to which the backrest 10 is fastened, is arranged pivotably in the bearings 1*a*. First lever arms 12 pointing upwards towards the seat frame 5*a* and second lever arms 13 pointing downwards towards the seat carrier 1 are connected firmly to the backrest carrier 9. The first and second lever arms are provided in duplicate, but are only shown singly in FIG. 3.

The first lever arms 12 are mounted pivotably at their ends in bearing blocks 5*c* of the seat frame 5*a*. Tension springs 14 arranged inside the hollow seat carrier 1 are suspended at the ends of the second lever arms 13.

The prestress of the tension springs 14 can be varied via a pull yoke 15*a* by means of a handwheel 15 mounted at the rear end of the seat carrier 1.

A pneumatic spring 16 is also articulated on the second lever arm and is mounted at its other end in the seat carrier 1 at the bearing point 16*a*.

The interaction between the pneumatic spring 16 and the adjustable tension spring 14 produces a damped synchronous movement of the seat backrest mechanism which can be locked or released in any position by continuous adjustment and which can be matched to the weight of the chair user by means of the handwheel 15.

A connecting line V between the pivot axis 11 and the pivot axis R of the backrest 10 forms an angle of 30° with the vertical when the seat furniture is in the so-called 0 position (initial position). Such an arrangement has proved particularly advantageous.

The chair column S has a tilt of 20° relative to the vertical and joins the seat carrier 1 at a distance z (measured horizontally from the rear edge of the seat 5). The distance z amounts to approximately $\frac{1}{3}$ of the total seat depth.

FIG. 1 of the drawings illustrates the position of the seat furniture inclined to the rear by means of dot-and-dash lines. In this position, the seat 5 is shifted to the rear by an amount x and lowered at the front edge by an amount y. At the same time, the inclination of the seat has changed by the angle $\alpha$.

We claim:

1. Seat furniture having a seat and backrest so arranged that the backrest can be tilted rearwardly without raising the front edge of the seat, said seat furniture comprising a supporting structure having a seat carrier fixed thereto, said seat carrier having an inclined front region, a seat articulated pivotally at its front edge on said front region of seat carrier, said seat being longitudinally displaceable, a backrest carrier having a backrest, said backrest carrier being fixedly attached to a lever mechanism, said lever mechanism being pivotally attached to said seat carrier and defining first and second lever arms extending in different directions respectively from the pivot axis of said lever mechanism, said seat being pivotally attached to said first lever arm of said lever mechanism at a position spaced from the pivot axis of said lever mechanism, said backrest carrier being attached to said lever mechanism adjacent said pivot axis of said lever mechanism, and spring means connected to said second lever arm of said lever mechanism.

2. Seat furniture according to claim 1 wherein said spring means comprises an adjustable tension spring and a pneumatic spring each of which engages said second lever arm at a position thereon spaced from the pivot axis of said lever mechanism.

3. Seat furniture according to claim 1 or claim 2 wherein said front edge of said seat has a cylindrical region which receives at least one cylindrical peg having a transverse bore, a pin attached to said seat carrier being disposed in said transverse bore and being longitudinally displaceable in said bore.

4. Seat furniture according to claim 1 wherein said supporting structure comprises at least one chair column that is fixedly attached to said seat carrier, the pivot axis of said lever mechanism being located forwardly of the junction point between said chair column and said seat carrier.

5. Seat furniture according to claim 4 wherein the junction between said seat column and said seat carrier is disposed forwardly of the rear edge of the seat by a horizontal distance which is approximately one third of the total seat depth.

6. Seat furniture according to claim 1 wherein said supporting structure comprises a single, centrally located, inclined chair column.

* * * * *